United States Patent [19]

Itoh et al.

[11] 4,090,484

[45] May 23, 1978

[54] FUEL SUPPLY SYSTEM FOR MULTI-FUEL INTERNAL COMBUSTION ENGINES

[75] Inventors: Yukinori Itoh, Kawagoe; Mituhiko Shibata, Asukabe; Akira Masuda; Yasuo Ohtake, both of Ohmiya; Motoaki Etoh, Ageo, all of Japan

[73] Assignee: Fuji Jukogyo Kabushiki Kaisha, Tokyo, Japan

[21] Appl. No.: 713,512

[22] Filed: Aug. 11, 1976

[51] Int. Cl.[2] ..... F02M 13/00; F02M 13/09; F02M 13/08

[52] U.S. Cl. ..... 123/127

[58] Field of Search ..... 123/127, 179 G, 119 F, 123/121, 3; 261/18 R

[56] References Cited

U.S. PATENT DOCUMENTS

| | | | |
|---|---|---|---|
| 1,983,957 | 12/1934 | White | 261/18 R |
| 3,805,756 | 4/1974 | Madariaga | 123/127 |

FOREIGN PATENT DOCUMENTS

| | | | |
|---|---|---|---|
| 349,302 | 2/1922 | Germany | 123/127 |

*Primary Examiner*—Wendell E. Burns
*Attorney, Agent, or Firm*—Martin A. Farber

[57] ABSTRACT

Fuel supply system for multi-fuel internal combustion engines having a selector valve for controlling the feed of fuels such as gasoline and kerosene and vacuum actuator to operate the selector valve according to the pressure in intake passage of the engine. The system is provided for feeding the gasoline and kerosene at heavy load and low speed, feeding the gasoline at heavy load and high speed and feeding the kerosene at middle load.

3 Claims, 4 Drawing Figures

FUEL SUPPLY SYSTEM FOR MULTI-FUEL INTERNAL COMBUSTION ENGINES

The present invention relates to a fuel supply system for multi-fuel internal combustion engines such as gasoline-kerosene engines driven by gasoline and/or kerosene, and more particularly to a system for supplying gasoline and kerosene from each fuel chamber to the intake passage of carburetor.

Kerosene has practical difficulties as fuel for driving the gasoline-kerosene engine as described hereinafter. Since vaporability of kerosene is lower than that of gasoline, the fuel is not sufficiently atomized in the carburetor at a no-load or lower rotational speed of the engine. Further, since temperature of ignition plugs is not raised in the cold, the plugs are contaminated by the fuel, which causes misfiring. Further, larger particles of kerosene causes oil dilution. In addition, since kerosene has a higher viscosity than that of gasoline, response to a signal for fuel supply is delayed at rapid acceleration and deceleration. Accordingly, air-fuel mixture is liable to become leaner or richer, which will cause misfire or back fire. Further, knocking will occur in the engine at high speed and heavy load unless the compression ratio is considerably decreased compared with the gasoline engine, because the octane number of kerosene is lower than that of gasoline. The knocking occurs more easily as the temperature of combustion gas in the cylinder at an end of the combustion period rises and when the high temperature continues for long time. Therefore, the knocking occurs easily at low speed under heavy load.

The present invention overcomes the above described problems and disadvantages of the conventional multi-fuel engine. In accordance with the present invention, the fuel supply apparatus is adapted to feed gasoline and kerosene to the intake passage of carburetor at lighter load zone and low speed, to feed gasoline at a heaviest load zone and high speed, to feed gasoline and kerosene at heavy load zone and low speed and to feed kerosene at middle load. The fuel supply control is accomplished by operating selector valve according to pressure in intake passage of the carburetor.

The accompanying drawings illustrate the invention, in which.

Figure 1:
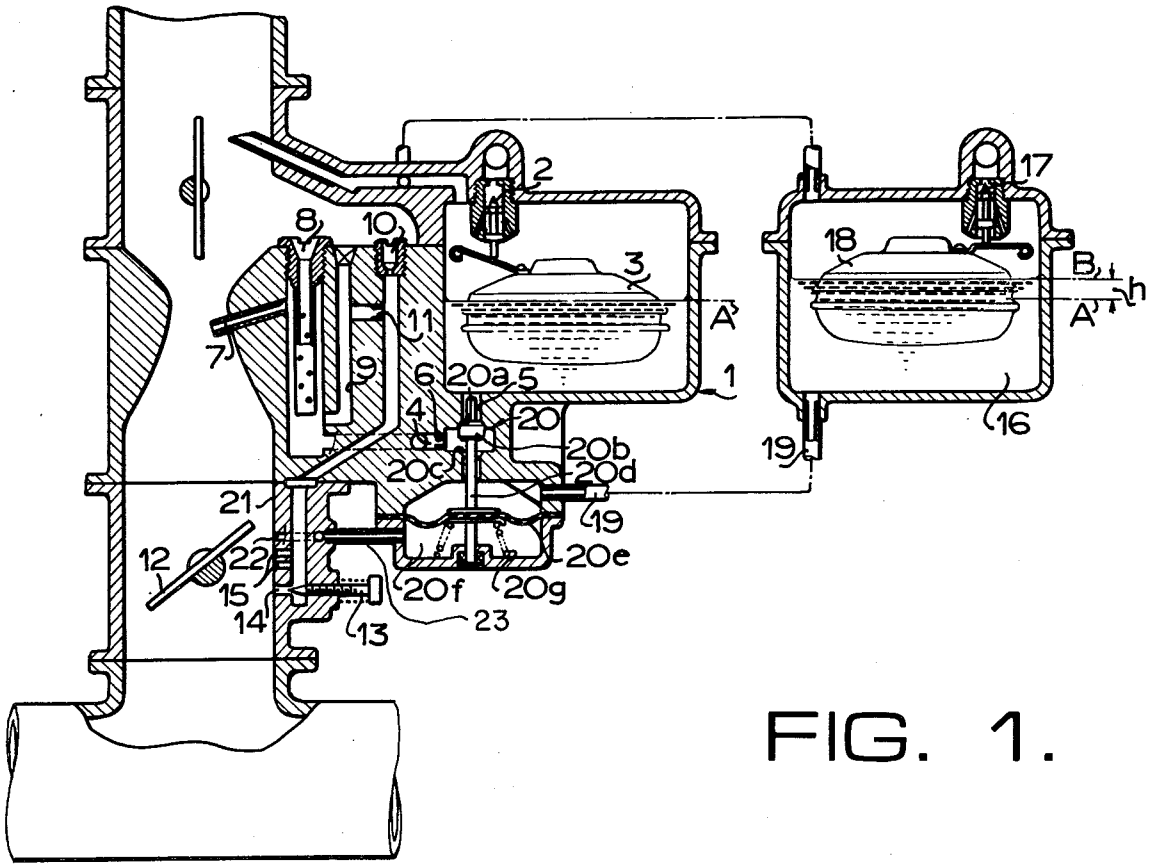
FIG. 1 is a sectional view showing a fuel supply system embodying the present invention.
Figure 2:
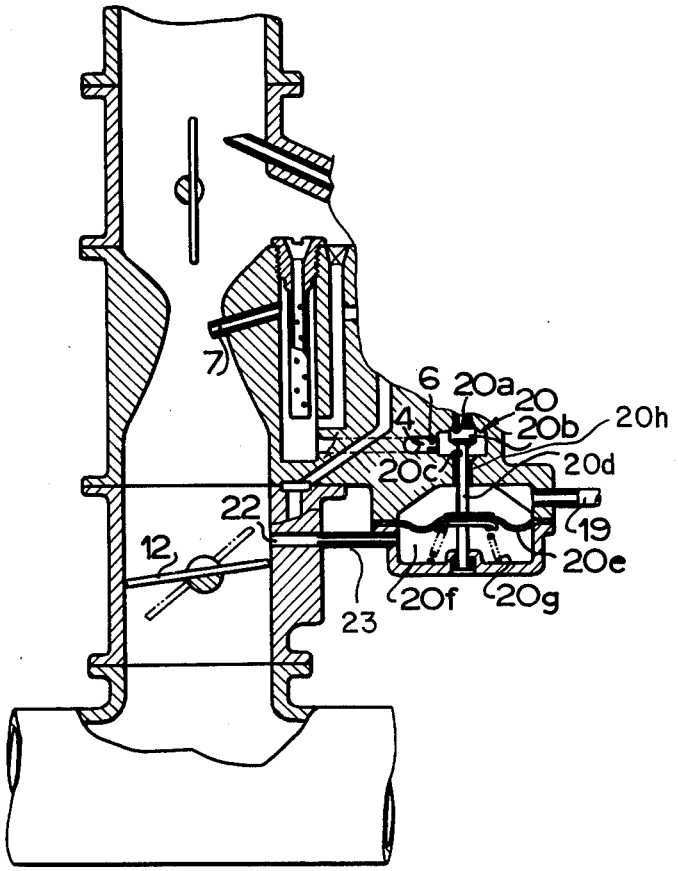
FIG. 2 is a sectional view showing a locational relation between the throttle valve and opening for taking the intake pressure in the intake passage.

Referring to the drawings and more particularly to FIG. 1, a kerosene float chamber of a carburetor is provided with a float needle valve 2 at the upper portion thereof and a float 3. In the bottom of the float chamber 1, a port 5 is provided to communicate to a main jet 6 through a selector valve 20. The main jet 6 is communicated to a main nozzle 7 by a fuel passage 4. Air is also introduced in the main nozzle 7 through a main air jet 8. A passage 9 is connected to the passage 4 to feed a fuel to a slow jet 11, fuel from the slow jet 11 and air from an idle air jet 10 being mixed with each other. The idler air jet 10 is communicated to a slow hole 14 and bypass ports 15 provided at a downstream side of a throttle valve 12. The slow hole 14 may be adjusted by an idle needle valve 13.

A gasoline float chamber 16 is provided with a float needle valve 17 at an upper portion thereof and a float 18 associated with the float needle valve 17. The gasoline float chamber 16 is communicated to the selector valve 20 through a conduit 19. The selector valve 20 is provided with a piston 20*b* adapted to abut on a valve seat 20*a* to close the port 5 and to abut on a valve seat 20*c* to close the port 20*h*. A rod 20*d* of the piston 20*b* is connected to a diaphragm 20*e* of a vacuum actuator. The vacuum actuator has a vacuum chamber 20*f* partitioned by the diaphragm 20*e*. A spring 20*g* is provided in the vacuum chamber to bias the diaphragm upwardly to abut the piston 20*b* on the valve seat 20*a*. The vacuum chamber 20*f* is communicated to a vacuum inlet 22 through a passage 23. The vacuum inlet 22 is provided in the wall of the intake passage of carburetor at a position adjacent slightly above the throttle valve closed position, for example at a distance of 0.5 to 5mm above the closed position of the throttle valve.

Figure 3:
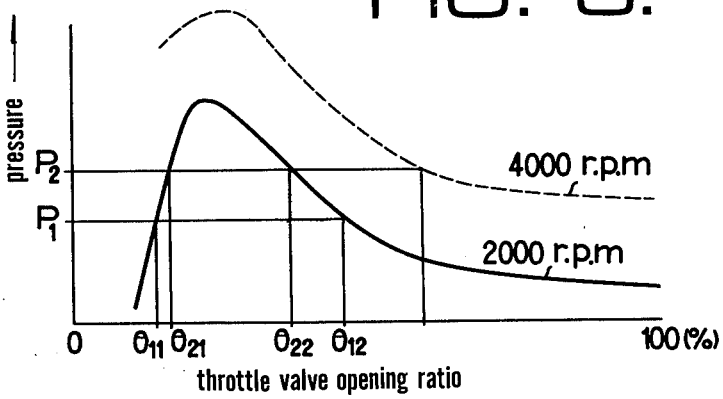
FIG. 3 is a graph showing a relation between opening ratio of the throttle valve and the intake pressure in the intake passage.

In the above described apparatus, the relation between pressure at the vacuum inlet 22 and opening ratio of the throttle valve is shown in FIG. 3. At the start of the engine, since the vacuum inlet 22 is positioned above the throttle valve, intake pressure is atmospheric pressure, and hence the piston 20*b* is biased upwardly by the spring 20*g* to close the port 5 and to open the port 20*h* of the valve seat 20*c*. Accordingly, gasoline in the float chamber 16 is fed to the main nozzle 7 passing through the conduit 19, main jet 6 and fuel passage 4. At no-load or a lightest load zone and at speed of 2000 rpm. in which the opening ratio of the throttle valve is less than $\theta_{11}$ in FIG. 3, intake negative pressure is less than $P_1$. Under this condition, suction force exerted on the diaphragm 20*e* is smaller than the spring biasing force, so that the port 5 is closed by the piston 20*b*. Therefore, gasoline is fed to the main nozzle 7. When the throttle valve has an opening ratio of between $\theta_{11}$ and $\theta_{21}$ (at a lighter load zone than the middle load zone), intake negative pressure is greater than $P_1$ and smaller than $P_2$, because the vacuum inlet 22 is located below the throttle valve. In this range, the diaphragm 20*e* is biased downwardly against the spring 20*g* by the negative pressure, which causes the piston to move to open the port 5, but the port 20*h* in the valve seat 20*c* is kept in open position by balancing of spring force and negative pressure. Thus, kerosene is permitted to flow through the port 5. Accordingly, a mixture fuel of gasoline and kerosene is fed to the main nozzle 7. It will be noted that feed ratio of gasoline is determined by the difference "*h*" between the level A of the kerosene in the chamber 1 and the level B of the gasoline in the chamber 16.

At the middle load in which the throttle valve 12 is opened at a ratio of between $\theta_{21}$ and $\theta_{22}$, the piston 20*b* abuts on the valve seat 20*c* to close the port 20*h*. Thus, only kerosene is fed to the carburetor. At a still heavier load zone, the throttle valve has an opening ratio of between $\theta_{22}$ and $\theta_{12}$, where the piston 20*b* takes a middle position. Therefore, a mixture fuel of gasoline and kerosene is again supplied to the main nozzle 7. When the throttle valve is opened at a heaviest load zone over $\theta_{12}$, the diaphragm 20*e* is biased upwardly by the spring 20*g* so that the port 5 is closed by the piston 20*b*. Accordingly, gasoline is fed to the carburetor.

Figure 4:
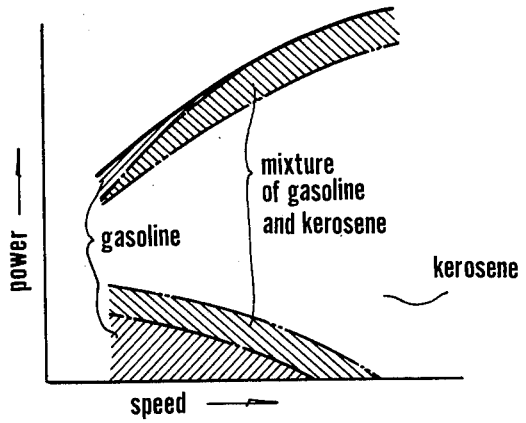
FIG. 4 is a graph showing a relation between power and speed of an engine employing a fuel supply apparatus according to the present invention.

When the engine speed is increased, for example to 4000 rpm, intake pressure is not decreased below $P_1$ at a heaviest load zone as shown in FIG. 3 by the dotted line. Therefore, a mixture fuel of gasoline and kerosene is fed to the carburetor. FIG. 4 shows a relation between speed and power of an engine employing a fuel supply system of the present invention.

From the foregoing it will be understood that the present invention provides an apparatus which may supply gasoline or kerosene or a mixture fuel thereof to the carburetor according to the operating condition of the engine, whereby the engine may be effectively operated without a decrease of power.

What is claimed is:

1. A fuel supply system for multi-fuel internal combustion engines having a carburetor intake passage with a throttle valve therein comprising a carburetor including a wall defining the carburetor intake passage and a main nozzle communicating with said intake passage, a first fuel float chamber having a first fuel therein and defining a first chamber bottom port, a second fuel float chamber having a second fuel therein, said second fuel float chamber being adjacent said carburetor and defining a second chamber bottom port, valve means, comprising a selector valve and a vacuum actuator operatively connected to said selector valve, being disposed at a position adjacent said carburetor, said selector valve being vertically disposed under a bottom of said second fuel float chamber, said selector valve cooperatively comprising two valve ports including an upper valve port communicating with said second chamber bottom port of said second fuel float chamber, and a lower valve port communicating with said first chamber bottom port of said first fuel float chamber, a main jet communicating with said two valve ports during an open condition of said valve ports and with said main nozzle of said carburetor, and a piston means for opening both of said two valve ports on the one hand, and for closing respectively either of said two valve ports, on the other hand, said vacuum actuator being disposed adjacent said carburetor, said vacuum actuator including a diaphragm defining on a lower side of said diaphragm a vacuum chamber disposed adjacent said intake passage of said carburetor, said diaphragm being connected to said piston means, spring means for upwardly biasing said diaphragm for pressing said piston means against said upper valve port for closing said upper valve port for the second fuel while opening said lower valve port for the first fuel, a vacuum inlet means in said wall of said intake passage of said carburetor at a distance of 0.5 to 5 mm above a closed position of the throttle valve in said intake passage, said vacuum inlet means being adjacent said vacuum chamber, and passage means for communicating said vacuum chamber with the adjacent said vacuum inlet means, whereby said passage means is short and vacuum may be transmitted to said vacuum chamber for downwardly biasing said diaphragm against said spring means to cause said piston means to open said upper valve port for the second fuel and to close said lower valve port at a middle load zone, and to cause said piston means to open both of said valve ports for supplying a mixture of both of the fuels at lighter and heavier load zones, respectively, than the middle load zone, and to cause said piston means to open said lower valve port for the first fuel and to close said upper valve port for the second fuel at lightest and heaviest load zones, respectively.

2. The fuel supply system for multi-fuel internal combustion engines in accordance with claim 1, wherein said first fuel float chamber contains gasoline and said second fuel float chamber contains kerosene.

3. A fuel supply system for multi-fuel internal combustion engines having a carburetor intake passage with a throttle valve therein comprising a carburetor including a wall defining the carburetor intake passage and a main nozzle communicating with said intake passage, a first fuel float chamber having a first fuel therein and defining a first chamber bottom port, a second fuel float chamber having a second fuel therein, said second fuel float chamber being adjacent said carburetor and defining a second chamber bottom port, a float level adjusting means disposed in each of said float chambers, respectively, for adjusting the levels of the respective fuels therein, valve means, comprising a selector valve and a vacuum actuator operatively connected to said selector valve, being disposed at a position adjacent said carburetor, said selector valve being vertically disposed under a bottom of said second fuel float chamber, said selector valve cooperatively comprising two valve ports including an upper valve port communicating with said second chamber bottom port of said second fuel float chamber, and a lower valve port communicating with said first chamber bottom port of said first fuel float chamber, a main jet communicating with said two valve ports during an open condition of said valve ports and with said main nozzle of said carburetor, and a piston means for opening both of said two valve ports on the one hand, and for closing respectively either of said two valve ports, on the other hand, said vacuum actuator being disposed adjacent said carburetor, said vacuum actuator including a diaphragm defining on a lower side of said diaphragm a vacuum chamber disposed adjacent said intake passage of said carburetor, said diaphragm being connected to said piston means, spring means for upwardly biasing said diaphragm for pressing said piston means against said upper valve port for closing said upper valve port for the second fuel while opening said lower valve port for the first fuel, a vacuum inlet means in said wall of said intake passage of said carburetor at a distance of 0.5 to 5 mm above a closed position of the throttle valve in said intake passage, said vacuum inlet means being adjacent said vacuum chamber, and passage means for communicating said vacuum chamber with the adjacent said vacuum inlet means, whereby said passage means is short and vacuum may be transmitted to said vacuum chamber for downwardly biasing said diaphragm against said spring means to cause said piston means to open said upper valve port for the second fuel and to close said lower valve port at a middle load zone, and to cause said piston means to open both of said valve ports for supplying a mixture of both of the fuels at lighter and heavier load zones, respectively, than the middle load zone, and to cause said piston means to open said lower valve port for the first fuel and to close said upper valve port for the second fuel at lightest and heaviest load zones, respectively.

* * * * *